US006933675B2

(12) United States Patent
Seo

(10) Patent No.: US 6,933,675 B2
(45) Date of Patent: Aug. 23, 2005

(54) APPARATUS FOR BLOCKING AMBIENT AIR OF ELECTRODELESS LIGHTING SYSTEM AND WAVEGUIDE THEREOF

(75) Inventor: Seong-Tae Seo, Daegu (KR)

(73) Assignee: LG Electronics Inc. (KR)

( * ) Notice: Subject to any disclaimer, the term of this patent is extended or adjusted under 35 U.S.C. 154(b) by 69 days.

(21) Appl. No.: 10/119,404

(22) Filed: Apr. 8, 2002

(65) Prior Publication Data

US 2003/0160553 A1 Aug. 28, 2003

(30) Foreign Application Priority Data

Feb. 22, 2002 (KR) ..... 2002-9660

(51) Int. Cl.[7] ..... H01J 65/04; H01J 7/26

(52) U.S. Cl. ..... 315/39; 315/248; 315/118; 315/267; 315/344; 313/24

(58) Field of Search ..... 315/39, 118, 248, 315/267, 39.51, 344, 246, 112; 313/24, 35, 231.31; 403/24

(56) References Cited

U.S. PATENT DOCUMENTS

| | | | | |
|---|---|---|---|---|
| 5,688,064 A | * | 11/1997 | Shanks | 403/24 |
| 5,998,934 A | * | 12/1999 | Mimasu et al. | 315/118 |
| 6,617,793 B2 | * | 9/2003 | Choi et al. | 315/39 |
| 6,680,576 B2 | * | 1/2004 | Jeon | 315/112 |
| 6,734,638 B2 | * | 5/2004 | Kang et al. | 315/248 |
| 6,784,619 B2 | * | 8/2004 | Choi | 315/39.51 |

FOREIGN PATENT DOCUMENTS

| | | |
|---|---|---|
| CN | 1298198 | 6/2001 |
| EP | 0 604 306 A1 | 12/1993 |
| JP | 2000-353495 | 12/2000 |
| JP | 2001-155505 | 6/2001 |
| WO | WO 0070651 | 11/2000 |

OTHER PUBLICATIONS

Office Action issued by Chinese Patent Office in connection with corresponding application No. 02119375.5 dated Dec. 31, 2004.

English translation of text of Chinese Office Action dated Dec. 31, 2004.

* cited by examiner

*Primary Examiner*—Don Wong
*Assistant Examiner*—Chuc Tran
(74) *Attorney, Agent, or Firm*—Ostrolenk, Faber, Gerb & Soffen, LLP

(57) ABSTRACT

An apparatus for blocking ambient air of an electrodeless lighting system comprises: a waveguide including a shaft hole so that a bulb shaft can be penetrated therethrough; a bulb motor mounted on a rear side of the waveguide and connected to a bulb, which is located on a front side of the waveguide, using the bulb shaft for rotating the bulb; and a sealing unit installed between the bulb motor and the waveguide for blocking inflow of ambient air to a direction of the bulb, that is, a sealing structure can be ensured so that the ambient air is not flowed into the light emitting area where the mesh screen is located, and thereby impurities are not flowed into the light emitting area to ensure the clear light emitting conditions, the oxidization of mesh screen can be reduced, and the stability of the lighting apparatus is improved and maintenance cost can be reduced.

20 Claims, 7 Drawing Sheets

APPARATUS FOR BLOCKING AMBIENT AIR OF ELECTRODELESS LIGHTING SYSTEM AND WAVEGUIDE THEREOF

BACKGROUND OF THE INVENTION

1. Field of the Invention

The present invention relates to an electrodeless lighting system using microwave, and particularly, to an apparatus for blocking ambient air of an electrodeless lighting system for preventing ambient air from flowing into an area where a bulb and a mesh screen are installed.

2. Description of the Background Art

Generally, an electrodeless lighting system is an apparatus for emitting visible rays or ultraviolet rays by radiating microwave to an electrodeless plasma bulb, and it has longer life span that that of incandescent lamp or fluorescent lamp and has superior lighting effect.

FIG. 1 is a longitudinal cross-sectional view showing an electrodeless lighting system according to the conventional art.

The conventional electrodeless lighting system comprises: a magnetron 2 installed in a case 1 for generating microwave; a high voltage generator 3 for providing the magnetron 2 with high voltage after raising the utility AC power source to the high voltage; a waveguide 4 for transmitting the microwave generated in the magnetron 2; a mesh screen 6 installed on an outlet portion of the waveguide for blocking a leakage of the microwave and for passing light; and a bulb 5, in which filled material becomes plasma by the microwave transmitted through the waveguide 4 to emit the light, located in the mesh screen 6.

In the electrodeless lighting system like above, a reflector 7 for reflecting forward the light generated in the bulb 5 is disposed around the mesh screen 6 in front of the case 1, and a mirror 8 for passing the microwave transmitted through the waveguide 4 and reflecting the light radiated from the bulb 5 is installed in an outlet portion 4*a* of the waveguide 4.

On the other hand, a fan housing 9*a*, a cooling fan 9*b*, and a fan motor 9*c* are installed on rear side of the case 1 for cooling down the magnetron 2 and the high voltage generator 3 as air cooling method.

In addition, a bulb motor 5*b* is installed on bottom surface of the waveguide 4 so as to rotate and cool down the bulb 5, and a bulb shaft 5*a* which is connected as penetrating the waveguide 4 is installed between the bulb motor 5*b* and the bulb 5.

And holes 4*b* and 8*a* are formed on the waveguide 4 and on the mirror 8 so as to pass the bulb shaft 5*a*.

In the electrodeless lighting system constructed above, when an electric source is applied to the high voltage generator 3, the high voltage generator 3 raises the utility AC power to high voltage and provides the magnetron 2 with the high voltage. And the magnetron 2 generates the microwave having ultra high frequency.

The generated microwave is radiated into the mesh screen 6 through the waveguide 4, and discharges the material filled in the bulb 5 to emit the light having its own emission spectrum. In addition, the light generated in the bulb 5 is reflected on the mirror 8 and the reflector 7 toward front side to illuminate a lighting area.

On the other hand, when the electrodeless lighting system is operated, the magnetron 2 and the high voltage generator 3 generate heat of high temperature. Therefore, the fan motor 9*c* and the cooling fan 9*b* are operated to cool down inside of the case 1 as the air cooling method.

That is, when the cooling fan 9*b* is operated, the air which is flowed into the case 1 through the fan housing 9*a* cools down the magnetron 2 and the high voltage generator 3 and then goes out through a discharge hole 1*a*.

However, the ambient air flowed into the case 1 as the cooling fan 9*b* is operated is also flowed in the light emitting area in which the bulb 5 and the mesh screen 6 are located through the hole 4*b* formed on a center part of the waveguide 4 and the hole 8*a* of the mirror 8.

In addition, impurities such as dust are also flowed with the ambient air when the air is flowed into the light emitting area where the bulb 5 and the mesh screen 6 are located, and the flowed ambient air and the impurities oxidizes the mesh screen 6 which is made using a metal. And therefore, the life span of the mesh screen 6 is reduced.

That is, the light emitting area in which the mesh screen 6 is located is considerably high temperature environment because the bulb 5 generates high temperature over 1000° C., and at that time, the ambient air and the impurities flowed into the light emitting area contact to the mesh screen 6 of metal, and therefore, the oxidation rate is greatly increased.

Therefore, if the mesh screen is oxidized and burned, the microwave may leak. Therefore, the stability of the lighting apparatus is decreased, and the maintenance cost of the lighting apparatus is very high because the mesh screen 6 needs to be replaced frequently.

SUMMARY OF THE INVENTION

Therefore, an object of the present invention is to provide an apparatus for blocking ambient air of an electrodeless lighting system which is able to prevent ambient air from being flowed into a light emitting area and to prevent the mesh screen from being damaged by sealing the light emitting area where the mesh screen is located so that the ambient air can not be flowed into the light emitting area.

Also, another object of the present invention is to provide an apparatus for blocking ambient air of an electrodeless lighting system which is able to increase stability of the lighting apparatus and reduce maintenance cost of the lighting apparatus by preventing the mesh screen from being oxidized and damaged.

To achieve these and other advantages and in accordance with the purpose of the present invention, as embodied and broadly described herein, there is provided an apparatus for blocking ambient air of an electrodeless lighting system comprising: a waveguide having a shaft hole so that a bulb shaft can be passed therethrough; a bulb motor mounted on rear side of the waveguide and connected to a bulb, which is located on front side of the waveguide, with the bulb shaft for rotating the bulb; and a sealing means installed between the bulb motor and the waveguide so as to block the ambient air toward the direction of the bulb.

According to an embodiment of the present invention, there is provided an electrodeless lighting system comprising: a case; a waveguide located in the case so as to be protruded toward outer side for transmitting microwave from a magnetron; a mesh screen installed on an outlet portion of the waveguide for blocking the microwave and passing light; a bulb located in the mesh screen for generating the light by the microwave; a bulb motor mounted on rear side of the waveguide and connected to the bulb using a bulb shaft inserted into the shaft hole for generating the bulb; and a sealing means installed between the bulb motor and the waveguide for blocking the ambient air toward the direction of the bulb.

The sealing means comprises a hole forming pipe extended from the front side of the waveguide toward the bulb motor direction for forming the shaft hole, and a first gasket member installed between the hole forming pipe and the bulb motor.

The hole forming pipe includes a gasket recess so that the gasket member can be mounted, and the gasket member is formed as an o-ring.

A second gasket member is installed between the case and the waveguide so as to prevent the ambient air from flowing into the area where the mesh screen is located.

The waveguide is fixed inside the case using a fixing bracket, and a plurality of the second gasket members are installed between the waveguide and the fixing bracket, and between the fixing bracket and the case, respectively.

The electrodeless lighting system further comprises a reflector installed on front side of the case for reflecting the light generated in the bulb toward the front direction, and a cover glass installed on front side of the reflector.

A third gasket member is installed between the case and the reflector so that the ambient air is not flowed into the area in which the mesh screen is located.

According to another embodiment of the present invention, there is provided an electrodeless lighting system comprising: a case; a waveguide having a shaft hole in front-rear direction located in the case so as to be protruded toward the outer side for transmitting microwave from a microwave generator; a mesh screen installed on an outlet portion of the waveguide for blocking the microwave and passing the light; a bulb located in the mesh screen for emitting the light by the microwave; a bulb motor mounted on rear side of the waveguide and connected to the bulb using a bulb shaft inserted in the shaft hole for rotating the bulb; a sealing means installed between the bulb motor and the waveguide for blocking the inflow of ambient air toward the direction of the bulb; and a globe of spherical shape installed on front side of the case so that the light generated in the bulb can be permeated to all directions.

A fourth gasket member is installed between the case and the reflector for blocking the inflow of the ambient air toward the area where the mesh screen is located.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
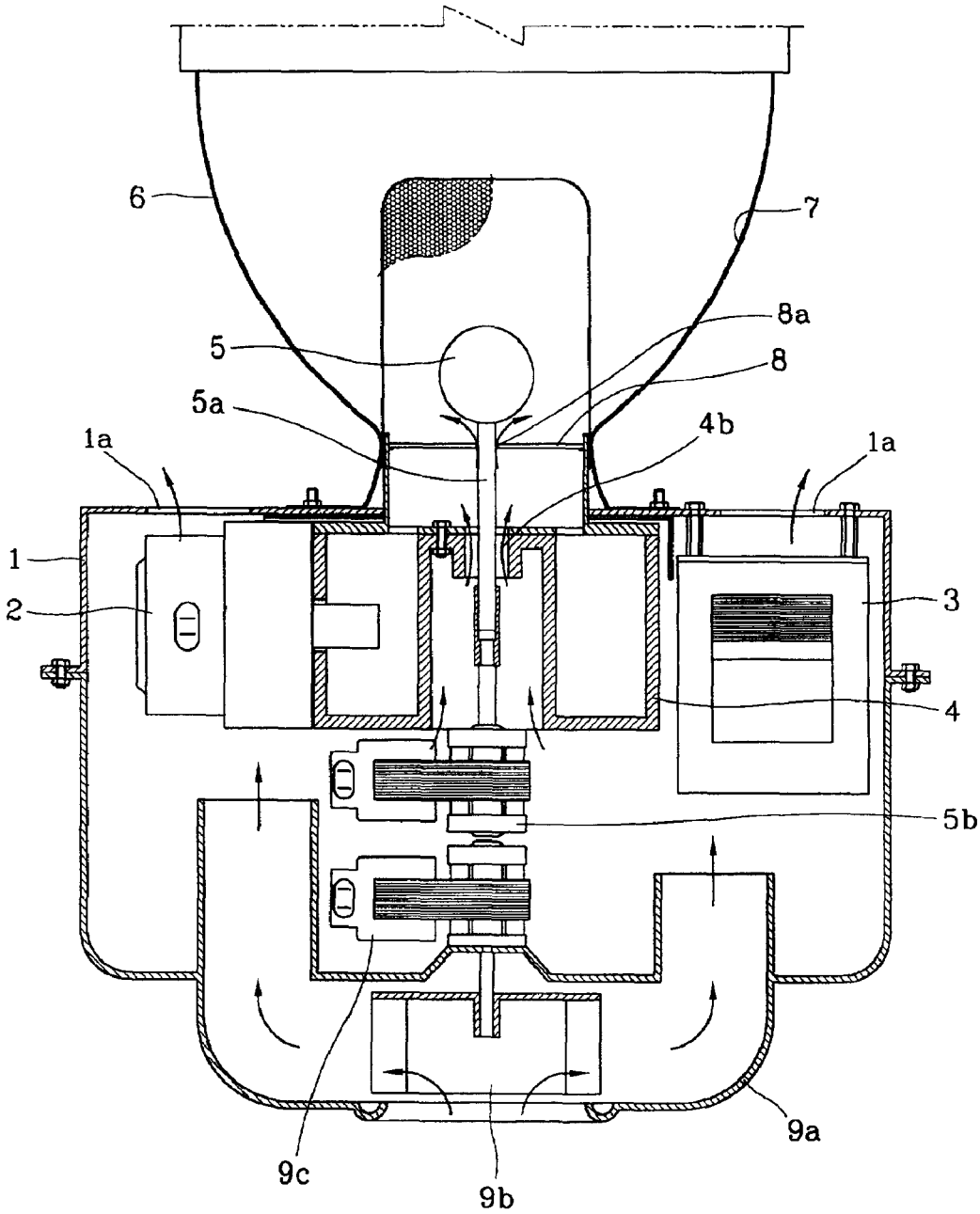
FIG. 1 BACKGROUND ART
FIG. 1 is a longitudinal cross-sectional view showing an electrodeless lighting system according to the conventional art.
Figure 2:
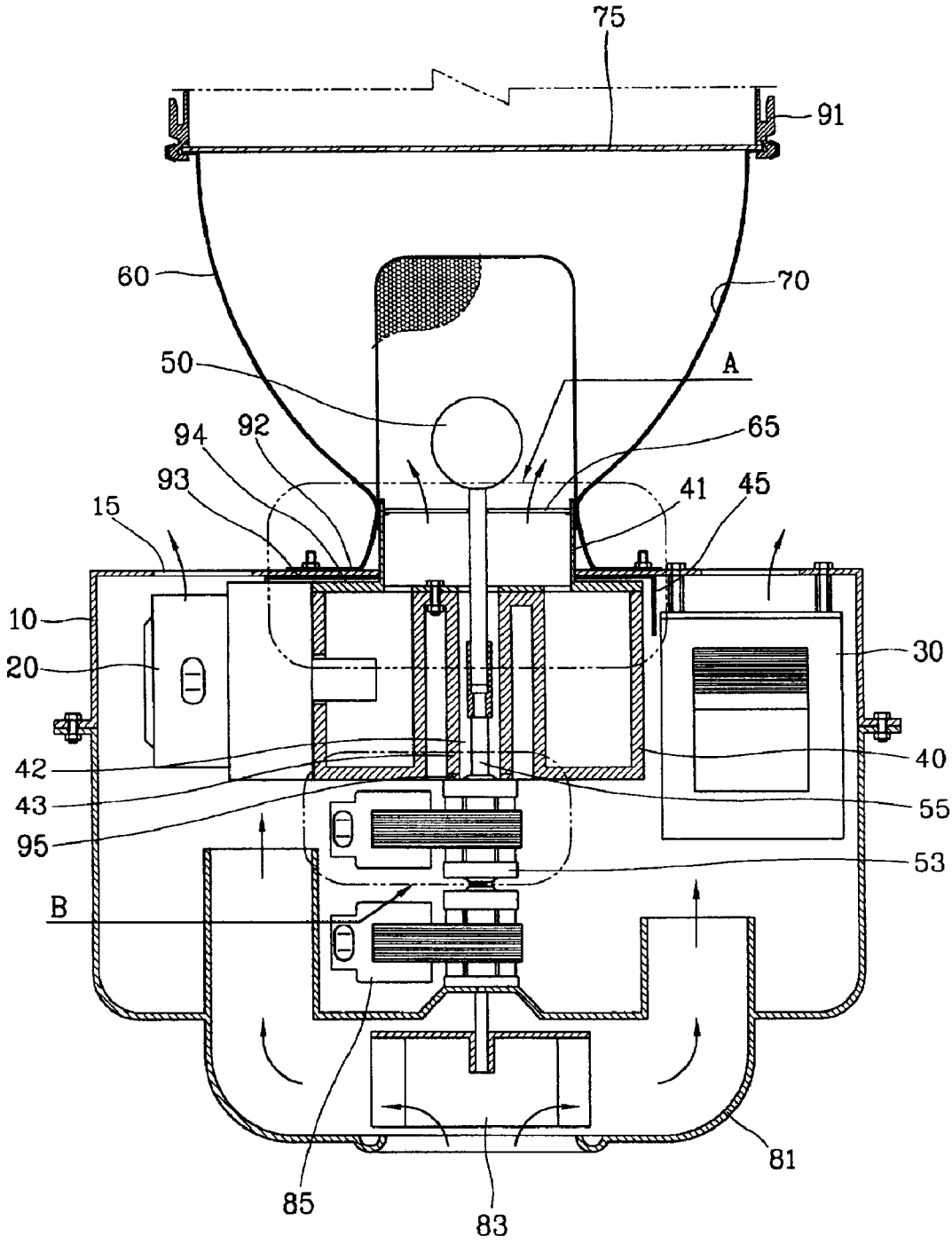
FIG. 2 is a longitudinal cross-sectional view showing an electrodeless lighting system according to a first embodiment of the present invention.
Figure 3:
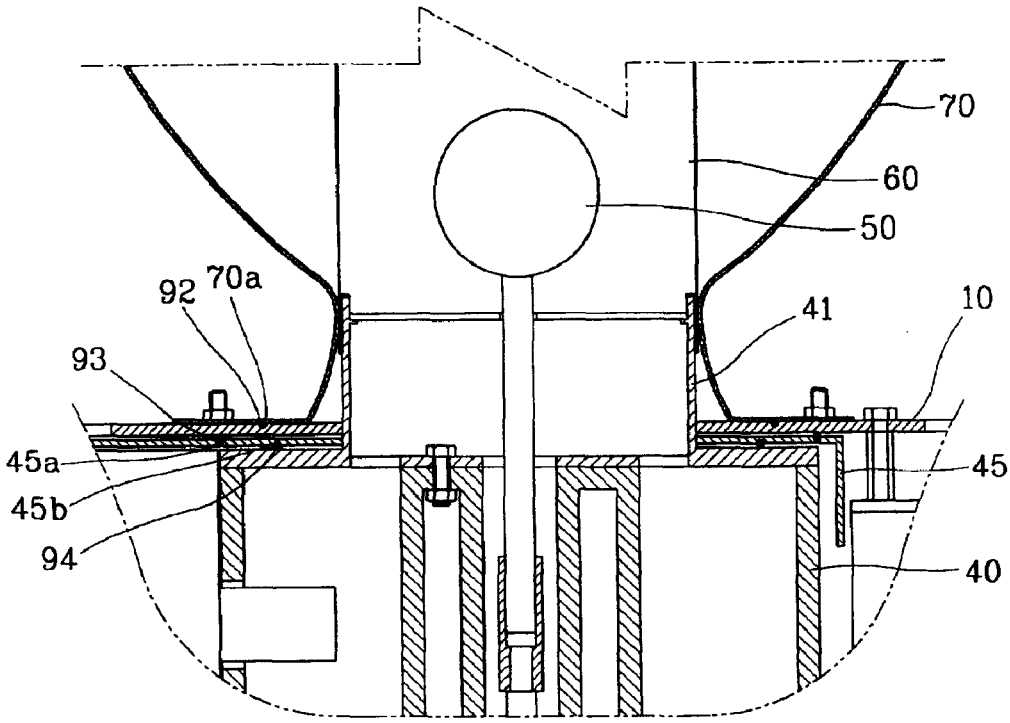
FIG. 3 is a detailed view showing "A" part in FIG. 2.
Figure 4:
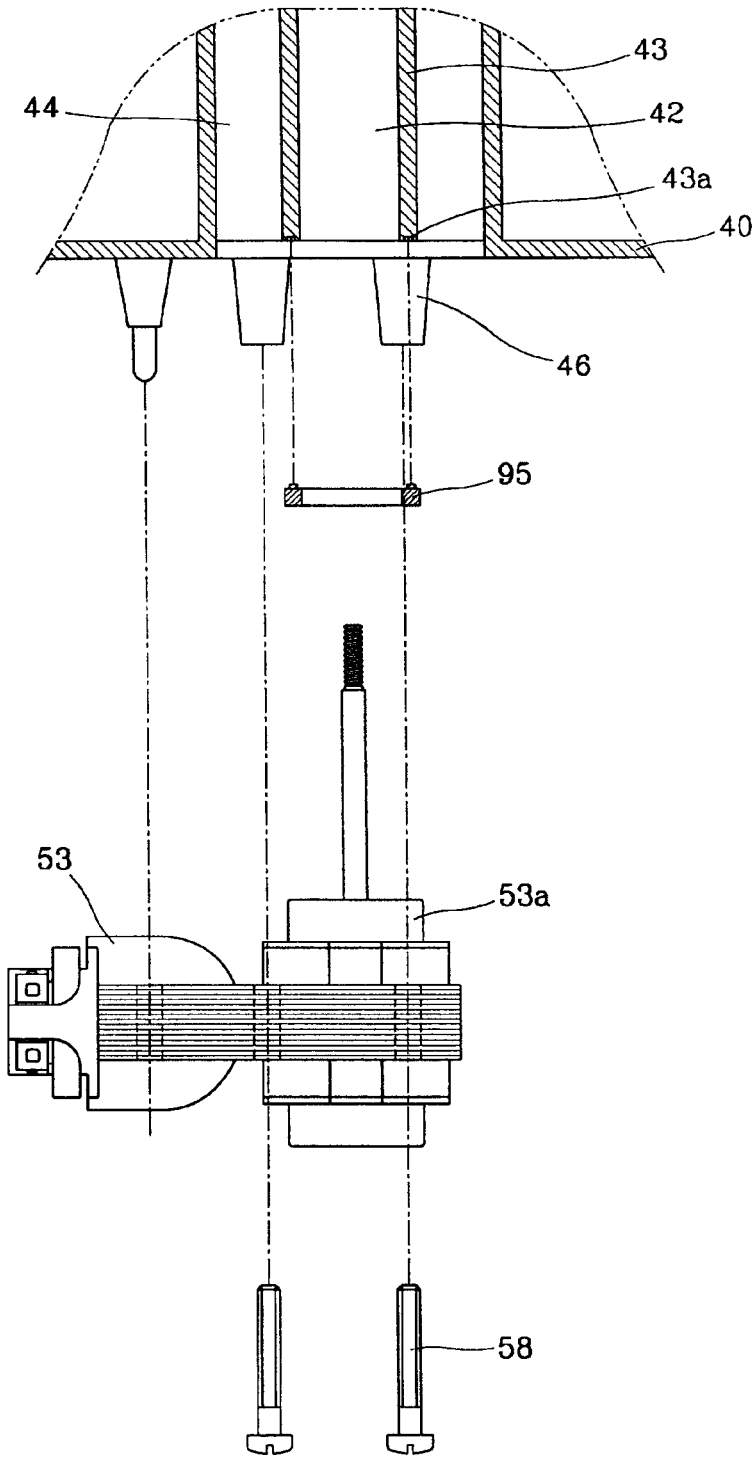
FIG. 4 is a detailed view showing disintegrated state of "B" part in FIG. 2.
Figure 5:
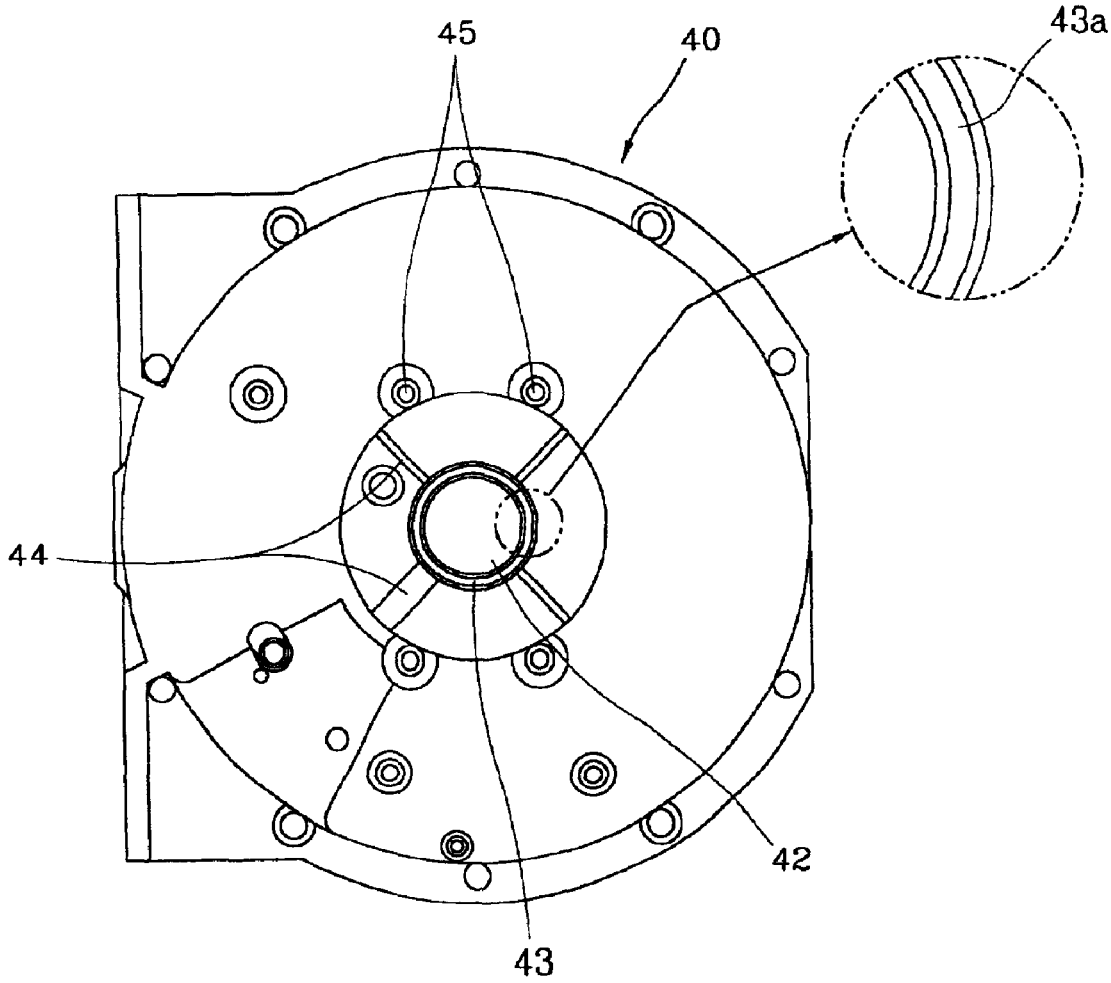
FIG. 5 is a bottom view showing a waveguide shown in FIG. 2.

FIG. 2 is a longitudinal view showing an electrodeless lighting system according to a first embodiment of the present invention, FIG. 3 is a detailed view showing "A" part of FIG. 2, FIG. 4 is a detailed view showing a disintegrated state of "B" part of FIG. 2, and FIG. 5 is a bottom view showing a waveguide shown in FIG. 2.

As shown in FIG. 2, a magnetron 20 for generating microwave and a high voltage generator 30 for raising utility AC power to high voltage and providing the high voltage are disposed in a case 10.

A waveguide 40 for transmitting microwave generated in the magnetron 20 is located between the magnetron 20 and the high voltage generator 30.

Herein, the waveguide 40 is fixed in the case 10 via a fixing bracket 45 in the state of being fixed on the fixing bracket 45, and an outlet portion 41 through which the microwave is discharged is located as protruded toward the front side of the case 10.

A mesh screen 60 for blocking a leakage of the microwave and passing the light is connected to the outlet portion of the waveguide 40, and a bulb 50, in which the filled material becomes plasma by the microwave energy transmitted through the waveguide 40 to emit the light, is installed in the mesh screen 60.

Herein, a mirror 65 for passing the microwave transmitted through the waveguide 40 and reflecting the light radiated from the bulb 50 toward the front direction is installed inside the outlet portion 41 of the waveguide.

A reflector 70 for reflecting the light generated in the bulb 50 toward the front direction intensively is installed on the front side of the case 10, and a cover glass 75 is disposed on front side of the reflector 75 so as to seal the inside and at the same time, to permeate the light toward the front direction.

A fan housing 81, a cooling fan 83, and a fan motor 85 are installed on rear side of the case 10 so as to cool down the magnetron 20 and the high voltage generator 30 using air cooling method, and a discharge hole 15 is formed on a front surface of the case 10 so as to discharge the air which was flowed in the case 10.

A bulb motor 53 is installed on a bottom surface of the waveguide 40 so as to cool down the bulb 50 as rotating the bulb, and the bulb motor 53 and the bulb 50 are mutually connected through a bulb shaft 55 which passes through a center part of the waveguide 40.

A shaft hole 42 is formed on the waveguide 40 so that the bulb shaft 55 cam be passed therethrough.

The above electrodeless lighting system is constructed so that the ambient air is flowed into the case 10 to cool down the magnetron 20, etc. Therefore, gasket members for blocking the inflow path of the ambient air are installed so that the light emitting area where the mesh screen 60 and the bulb 50 are located can be sealed completely from the outer side.

That is, the ambient air may be flowed into the area where the mesh screen 60 is located through a gap between the cover glass 75 and the reflector 70, a gap between the reflector 70 and the case 10, a gap between the case 10 and the bracket 45, a gap between the bracket 45 and the waveguide 40, and the shaft hole 42 through which the bulb shaft 55 is penetrated.

Therefore, a glass gasket 91 seals the part where the cover glass 75 and the reflector 70 is coupled.

In addition, as shown in FIG. 3, a reflector gasket 92, a first bracket gasket 93, and a second bracket gasket 94 are inserted into between the reflector 70 and front surface of the case 10, between an inner side surface of the case 10 and the fixing bracket 45, and between the fixing bracket 45 and the waveguide 40 respectively, and the inflow paths of the ambient air are blocked.

Herein, it is desirable that gasket recesses 70*a*, 45*a*, and 45*b* are formed on the reflector 70 and the bracket 45 so that the gaskets 92, 93, and 94 are inserted. Surely, the gasket recesses may be formed on the case 10 or the waveguide 40.

In addition, as shown in FIGS. 4 and 5, a hole forming pipe 43, which is extended from the front side of the waveguide 40 toward the direction of the bulb motor 53 for forming the shaft hole 42, is formed in order to seal the shaft hole 42 part of the waveguide 40 through which the bulb shaft 55 is penetrated.

A hole gasket 95 of o-ring shape is inserted between the hole forming pipe 43 and the bulb motor 53.

The hole forming pipe 43 includes a gasket recess 43*a* so that the hole gasket 95 can be mounted, and a supporting rib 44 of "+" structure is connected between the hole forming pipe and the main body of the waveguide 40 so as to support the hole forming pipe 43.

In addition, the bulb motor 53 includes a boss portion 53*a*, which is protruded than other parts of the motor, on a part where the shaft is protruded, and the hole gasket 95 is mounted between the boss portion 53*a* and the hole forming pipe 43.

On the other hand, the bulb motor 53 is mounted to a plurality of bosses 45 protruded on a bottom surface of the waveguide 40 as assembled using a screw 46.

Operation of the apparatus for blocking ambient air of the electrodeless lighting system according to the first embodiment of the present invention will be described as follows.

When the electrodeless lighting system is operated, the fan motor 85 and the cooling fan 83 are operated to make ambient air flow into the case 10, as shown in FIG. 2. The flowed air cools down the magnetron 20, and the high voltage generator 30, and then, goes out through the discharge hole 15 on the case 10.

Herein, the hole gasket 95, the first and second bracket gaskets 93 and 94 are installed on the shaft hole 42 part of the waveguide 40, between the waveguide 40 and the bracket 45, and between the bracket 45 and the case 10 respectively, and therefore, the ambient air can not be flowed into the light emitting area where the bulb 50 and the mesh screen 60 are located.

Also, the reflector gasket 92 and the glass gasket 91 are installed between the case 10 and the reflector 71, and between the reflector 70 and the cover glass 75, and therefore, the ambient air is not flowed in the reflector 70.

Therefore, the light emitting area, in which the mesh screen 60 and the bulb 50, surrounded by the cover glass 75, the reflector 70, the case 10, and the waveguide 40 is sealed completely from the outer side, and thereby the oxidization of the mesh screen 60 by being contacted to the outer air can be minimized and the damage of the mesh screen 60 can be prevented.

Also, the path to the inside of the light emitting area in the reflector 70 is completely blocked, and therefore, impurities such as dust which can be flowed with the outer air are not flowed into the light emitting area, and a clean emitting environment can be made.

Figure 6:
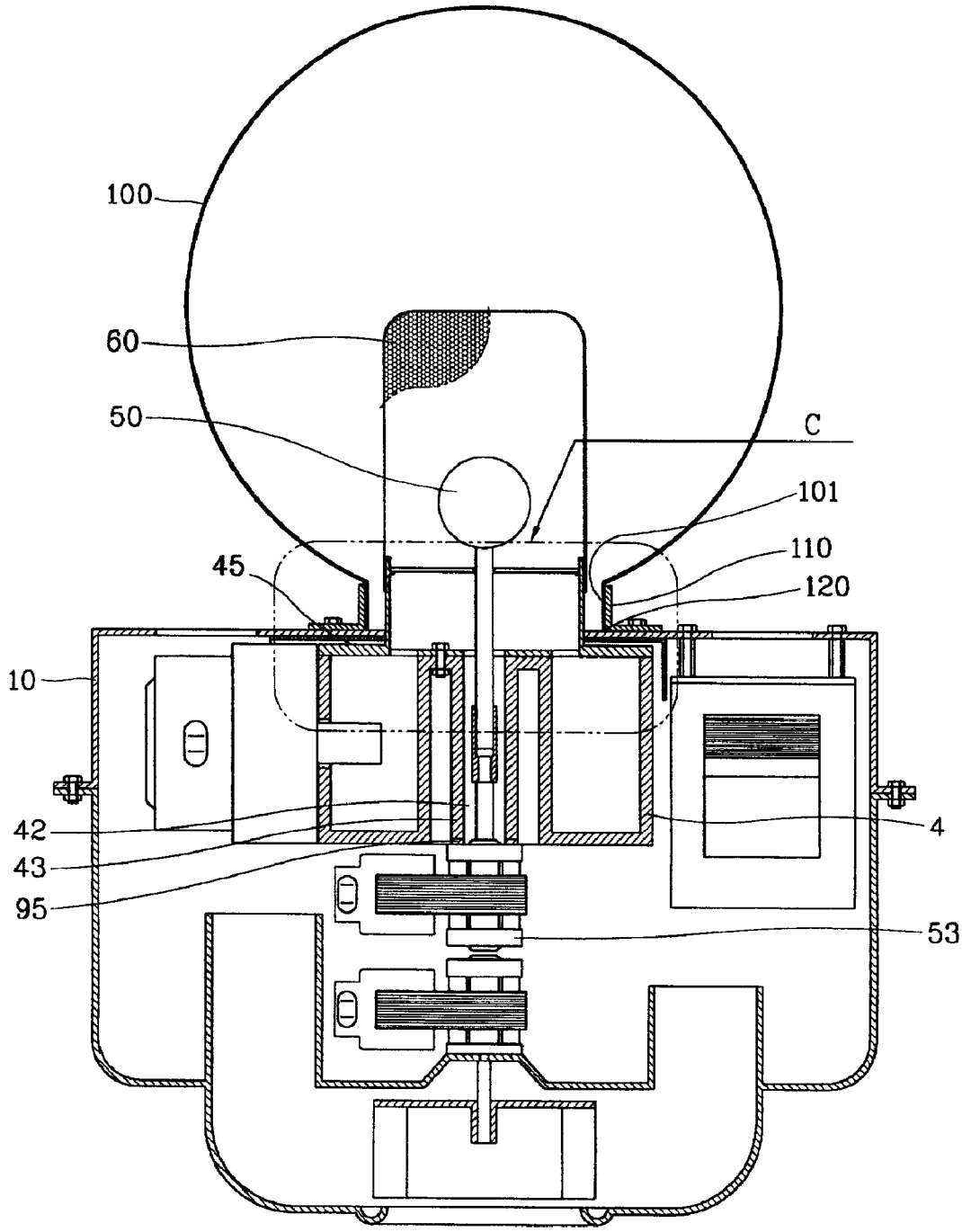
FIG. 6 is a longitudinal cross-sectional view showing an electrodeless lighting system according to a second embodiment of the present invention.
Figure 7:
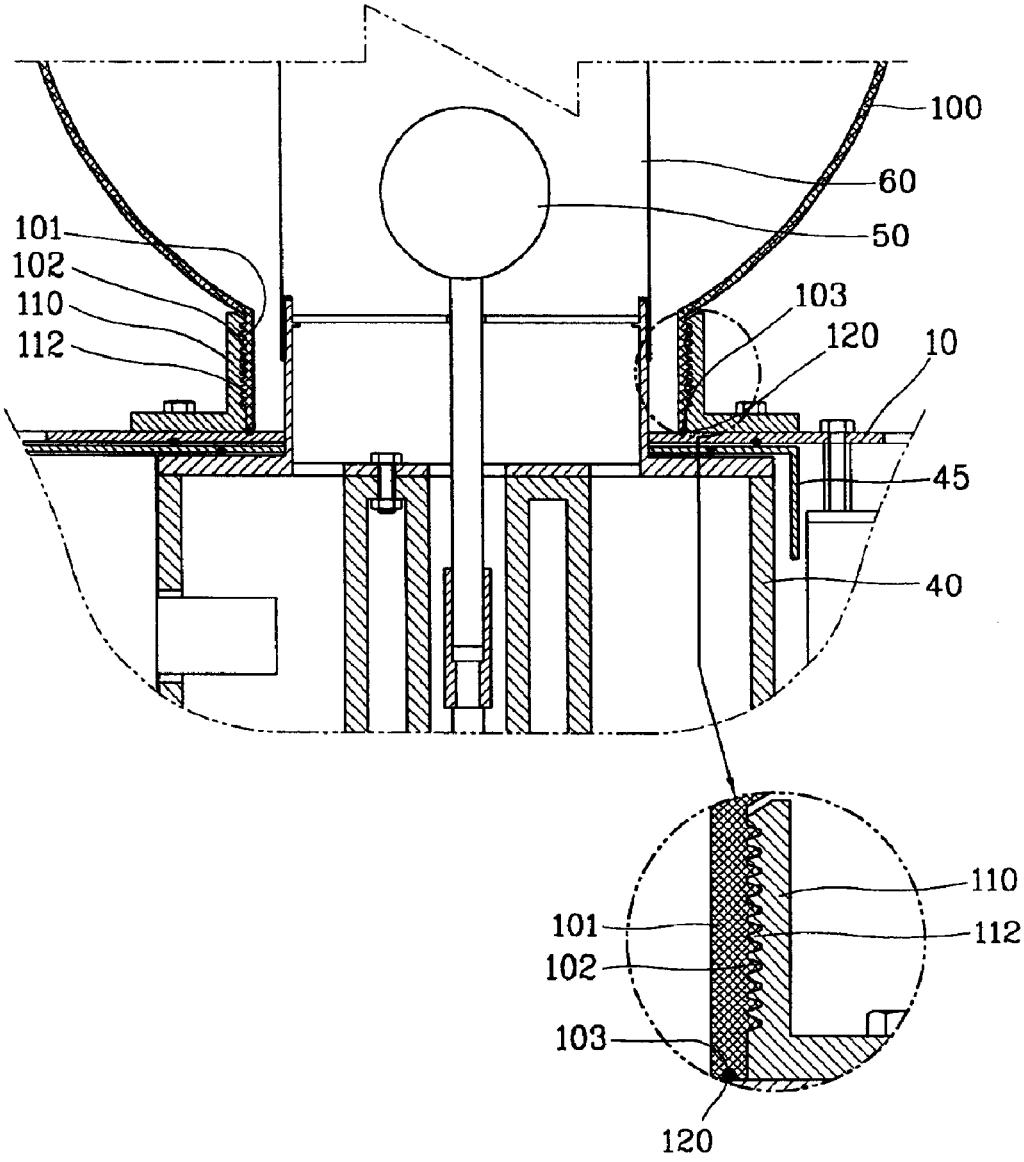
FIG. 7 is a detailed view showing "C" part in FIG. 6.

FIG. 6 is a longitudinal cross-sectional view showing an electrodeless lighting system according to the second embodiment of the present invention, and FIG. 7 is a detailed view showing "C" part in FIG. 6. Herein, same reference numerals are used for same parts as those of the first embodiment, and descriptions for those are omitted.

In the electrodeless lighting system according to the first embodiment of the present invention, the reflector is used for reflecting the light toward the front direction. However, in the electrodeless lighting system according to the second embodiment of the present invention, a globe 100 of spherical shape is installed so that the light generated in the bulb 50 can be reflected to all directions.

Herein, it is desirable that the globe 100 is made using an irregularly reflecting material in order to minimize glaring phenomenon that a user may feel, and only one surface is opened and fixed on the front surface of the case 10.

Referring to FIG. 7, the globe 100 includes a fixed portion 101 extended as a cylinder on the opened part, and a positive screw 102 is formed on an outer circumferential surface of the fixed portion 101. In addition, a fixing ring 110 in which a negative screw 112 is formed on an inner circumferential surface is installed on the case 10.

Therefore, the globe 100 is fixed on the fixing ring 110 as screw assembling method and installed on front side of the case 10.

At that time, a globe gasket 120 is inserted between the fixed portion 110 of the globe 100 and the front surface of the case 10 in order to block the inflow of the ambient air. In addition, it is desirable that a gasket recess 102 is formed on the globe 100 or on the case 100 so that the globe gasket 120 can be inserted therein.

On the other hand, sealing structures of the gap between the case 10 and the bracket 45, the gap between the bracket 45 and the waveguide 40, and the shaft hole 42 part of the waveguide 40 are same as those of the first embodiment.

In the electrodeless lighting system according to the second embodiment of the present invention, the light emitting area inside the globe 100 is blocked completely from the outer side. Therefore, the oxidization of the mesh screen 60 can be minimized, and the inflow of impurities such as the dust is prevented, thereby clean lighting emitting environment can be made.

According to the apparatus for blocking ambient air of the electrodeless lighting system of the present invention, a sealing structure can be ensured so that the ambient air is not flowed into the light emitting area where the mesh screen is located, and therefore, the impurities are not flowed into the light emitting area. Therefore, clear light emitting conditions can be ensured, and the phenomenon that the mesh screen is oxidized by the ambient air can be reduced.

Also, according to the present invention, the oxidization and damage of the mesh screen are prevented, and therefore, the stability of the lighting apparatus can be improved and the maintenance cost can be reduced.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An apparatus for blocking ambient air of an electrodeless lighting system, comprising:

a waveguide including a shaft hole so that a bulb shaft can penetrate therethrough;

a bulb motor mounted on a rear side of the waveguide and connected to a bulb by the bulb shaft, said bulb located on a front side of the waveguide; and a hole forming pipe extending from a front side of the waveguide toward the bulb motor, for forming the shaft hole; and a hole gasket installed between the hole forming pipe and the bulb motor, wherein the hole forming pipe includes a gasket recess so that the hole gasket can be mounted thereon.

2. The apparatus of claim 1, wherein the bulb motor includes a boss portion where the bulb shaft protrudes; and the hole gasket is mounted between the hole forming pipe and the boss portion of the bulb motor.

3. The apparatus of claim 1, wherein the hole gasket is formed in an o-ring shape.

4. The apparatus of claim 1, wherein the waveguide comprises:

a supporting rib formed between the hole forming pipe and a main body for supporting the hole forming pipe.

5. The apparatus of claim 4, wherein the supporting rib is formed as a "+" structure centered around the hole forming pipe.

6. An apparatus for blocking ambient air of an electrodeless lighting system, comprising:

a case;

a waveguide including a shaft hole through which a bulb shaft penetrates;

a mesh screen installed on an outlet portion of the waveguide, for blocking microwave energy and passing light;

a bulb located in the mesh screen, for emitting light by the microwave energy;

a bulb motor mounted on a rear side of the waveguide and connected to the bulb by the bulb shaft;

a sealing member installed between the bulb motor and the waveguide; and a gasket installed between the case and the waveguide in order to prevent ambient air from flowing into an area where the mesh screen is located.

7. The apparatus of claim 6, wherein the sealing member comprises:

a hole forming pipe extending from a front side of the waveguide toward the bulb motor; and a hole gasket installed between the hole forming pipe and the bulb motor.

8. The apparatus of claim 6, wherein the waveguide is fixed in the case by a fixing bracket, and a plurality of gaskets are installed between the waveguide and the fixing bracket and between the case and the fixing bracket.

9. The apparatus of claim 6, wherein the fixing bracket has a plurality of gasket recesses in which a plurality of gaskets are inserted.

10. The apparatus of claim 6, further comprising:

a reflector installed on a front side of the case, for reflecting the light generated in the bulb;

a cover glass installed on a front side of the reflector; and a glass gasket installed between the reflector and the cover glass in order to prevent ambient air from flowing into the area where the mesh screen is located.

11. The apparatus of claim 10, further comprising:

a reflector gasket installed between the case and the reflector in order to prevent ambient air from flowing into the area where the mesh screen is located.

12. The apparatus of claim 6, further comprising:

a globe of spherical shape installed on a front side of the case, for permeating the light generated in the bulb; and a globe gasket installed between the case and the globe, for preventing ambient air from flowing into the area where the mesh screen is located.

13. An apparatus for blocking ambient air of an electrodeless lighting system, comprising:

a case;

a waveguide including a shaft hole through which a bulb shaft penetrates;

a mesh screen installed on an outlet portion of the waveguide, for blocking microwave energy and passing light;

a bulb located in the mesh screen, for emitting light by the microwave energy;

a bulb motor mounted on a rear side of the waveguide and connected to the bulb by the bulb shaft;

a reflector installed on a front side of the case, for reflecting the light generated in the bulb;

a cover glass installed on a front side of the reflector;

a sealing member installed between the bulb motor and the waveguide; and a reflector gasket installed between the case and the reflector in order to prevent ambient air from flowing into an area where the mesh screen is located.

14. The apparatus of claim 13, further comprising:

a plurality of gaskets respectively installed between the waveguide and a fixing bracket for fixing the waveguide to the case and between the case and the fixing bracket.

15. The apparatus of claim 14, wherein the fixing bracket has a plurality of gasket recesses in which a plurality of gaskets are inserted.

16. The apparatus of claim 14, further comprising:

a glass gasket installed between the reflector and the cover glass in order to prevent ambient air from flowing into the area where the mesh screen is located.

17. An apparatus for blocking ambient air of an electrodeless lighting system, comprising:

a case;

a waveguide including a shaft hole through which a bulb shaft is penetrated;

a mesh screen installed on an outlet portion of the waveguide, for blocking microwave energy and passing light;

a bulb located in the mesh screen, for emitting light by the microwave energy;

a bulb motor mounted on a rear side of the waveguide and connected to the bulb by the bulb shaft;

a globe of spherical shape installed on a front side of the case, for permeating the light generated in the bulb;

a sealing member installed between the bulb motor and the waveguide; and a globe gasket installed between the case and the globe, for preventing ambient air from flowing into an area where the mesh screen is located.

18. The apparatus of claim 17, wherein the globe has a cylindrical fixed portion extended at an opened part communicated to the outlet portion of the waveguide, said fixed portion extended at an opened part communicated to the outlet portion of the waveguide, said fixed portion formed with screw threads on a circumferential surface thereof; and a fixing ring having screw threads on a circumferential surface thereof is installed on the case so that the fixed portion of the globe is coupled thereto.

19. The apparatus of claim 18, wherein the globe gasket is inserted between the fixed portion of the globe and a front surface of the case.

20. The apparatus of claim 19, wherein a gasket recess is formed in the fixed portion of the globe or on the front surface of the case, so that the globe gasket is inserted therein.

* * * * *